United States Patent [19]

Nishimura et al.

[11] 4,433,357

[45] Feb. 21, 1984

[54] DRIVE CIRCUIT FOR A LATCHING RELAY

[75] Inventors: Hiromi Nishimura; Yoshie Watari; Yuusaku Matsubara, all of Osaka, Japan

[73] Assignee: Matsushita Electric Works Ltd., Osaka, Japan

[21] Appl. No.: 309,397

[22] Filed: Oct. 7, 1981

[30] Foreign Application Priority Data

| | | | |
|---|---|---|---|
| Oct. 13, 1980 | [JP] | Japan | 55-143536 |
| Oct. 13, 1980 | [JP] | Japan | 55-143537 |
| May 31, 1981 | [JP] | Japan | 56-83229 |

[51] Int. Cl.[3] ..... H01H 47/18

[52] U.S. Cl. ..... 361/196; 361/153; 361/195

[58] Field of Search ..... 361/195, 196, 208, 186, 361/153, 29, 28, 91

[56] References Cited

U.S. PATENT DOCUMENTS

| | | | |
|---|---|---|---|
| 3,931,550 | 1/1976 | Dalpee | 361/186 |
| 3,974,422 | 8/1976 | Konig | 361/29 |
| 4,012,673 | 3/1977 | Saarem et al. | 361/196 |
| 4,355,342 | 10/1982 | Franzolini | 361/91 |

*Primary Examiner*—Reinhard J. Eisenzopf
*Attorney, Agent, or Firm*—Michael J. Striker

[57] ABSTRACT

A drive circuit for a latching relay includes a flip-flop, a timer and a semiconductive switching circuit for the relay. First and second input signals are applied to the flip-flop and first and second control signals at the output of the flip-flop are applied alternately to the timer as a time limit output for controlling the energization of the switching circuit in concert with a high-speed changeover signal.

4 Claims, 13 Drawing Figures

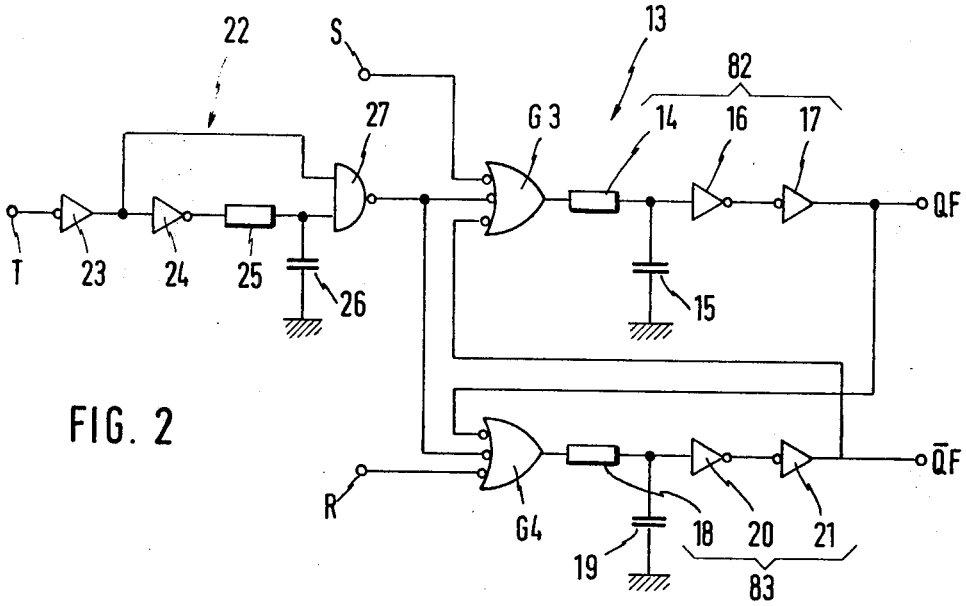
FIG. 2
FIG. 3
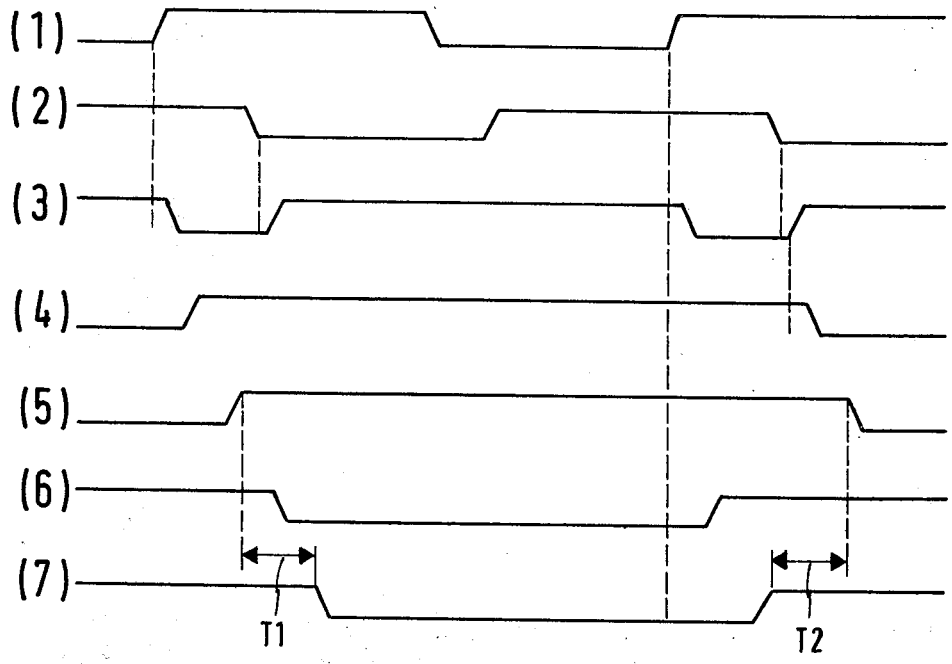

DRIVE CIRCUIT FOR A LATCHING RELAY

BACKGROUND OF THE INVENTION

This invention relates to a drive circuit for a latching relay which keeps an existing condition even when an input or control signal is cut off.

It has been well-known that this kind of latching relay does not require a continued current to its coil for keeping the relay in its working condition.

Such latching relays have been proposed, for example, in Japanese Utility Model Publication No. 48702/1977 and Federal Republic German Patent No. 1279777.

These known circuits are so constructed that a condenser and a latching relay are connected in series to a supply voltage of 100 to 200 V, and via a switch a unidirectional current flows into the latching relay to be actuated. The condenser, after a given time period, is charged to cut off the current, and thereafter the latching relay is kept mechanically in the existing working condition. Upon turning off the switch, the condenser discharges so that the discharge current flows in the latching relay as an inverse current through a switching circuit of semiconductor, such as transistor, thereby inverting the working condition of the relay.

These drive circuits are disadvantageous in that larger capacity condensers are needed which are inapplicable for an integrated circuit, and that the small-sized latching relay cannot house such large-sized condensers.

Japanese Patent No. 80231/1980 has proposed a solution how to overcome the above disadvantage.

This solution employs no condenser but a combination of transistors, which, similarly to the former prior arts, connects a drive circuit of transistors and a latching relay in series to the supply voltage of 100–200 V.

The Japanese patent, however, is not applicable and developable to computers, and so is the case of course with the aforementioned Japanese utility model and the German patent. According to the Japanese patent, the latching relay is changed over at high speed by output bits of a central processing unit (CPU) and connected to a programmable logic controller (PLC).

The CPU changes over the relay, for example, at high speed of 100 μsec by eight output bits. On the contrary, a time period necessary for changing over the latching relay, i.e., a time period for flowing a current in coils of the relay, is 100 msec, which considerably differs from the above mentioned speed.

Therefore, in the Japanese patent No. 80231/1980, the latching relay cannot follow such high speed change-over and no circuit is provided for compensating it.

SUMMARY OF THE INVENTION

An object of the invention is to provide a drive circuit for a latching relay, which not only solves the above problem but also achieves a novel development in manufacture, application and a technical value in such a manner that first and second input signals are responded by a flip-flop, a first control signal and an inverse control signal are alternately output and brought into a timer and used as the time limit output, so that, even when the first and second input signals are given in an extremely short time, a semiconductor switching circuit is energized to be kept on for a time period of a working current necessary for energizing the latching relay, thereby corresponding to the high speed changeover signal.

Another object of the invention is to provide a drive circuit for a latching relay, which is provided at the flip-flop with a delay circuit to cut a noise input signal, thereby preventing a malfunction of the latching relay.

Still another object of the invention is to provide a drive circuit for a latching relay, which is provided at a flip-flop with a pair of circuits consisting of a delay circuit and a logic gate connected in series, an input-output terminal of one of the series connected circuits being connected in feedback to an input-output terminal of the other circuit, so that, when a logic value of each output becomes temporarily equal, set and reset outputs for the timer are made equal in the time period and the first and second input signals are distinguished from other noise signals.

A further object of the invention is to provide a drive circuit for a latching relay, which has a timer comprising flip-flops in a plurality of stages connected in continuation and a multivibrator for giving an oscillation signal periodically to the flip-flop at the initial stage, an output of the flip-flop at the last stage restricting the operation of multivibrator and being led out as a time limit output of the timer, and which is provided with a gate means for blocking reception of sequential input signals, thereby cutting the following signals probably entering into the latching relay during the operation thereof.

Still a further object of the invention is to provide a drive circuit for a latching relay, which detects a supply voltage at a semiconductor switching and keeps the flip-flops in the predetermined stable condition when the supply voltage is under the predetermined discrimination level, so that the flip-flops, even when, for example, the power supply is stopped during the working of latching relay, are kept always in a reset condition, thereby preventing the reset condition of only one of a number of relays.

BRIEF DESCRIPTION OF THE DRAWING

An exemplary embodiment of a drive circuit for a latching relay of the invention will be described in detail in connection with the accompanying drawings in which

FIG. 2 is a detailed circuit diagram of a flip-flop in FIG. 1;

FIG. 3 is a plot of signals in the flip-flop of FIG. 2;

DESCRIPTION OF THE PREFERRED EMBODIMENTS

Figure 1:
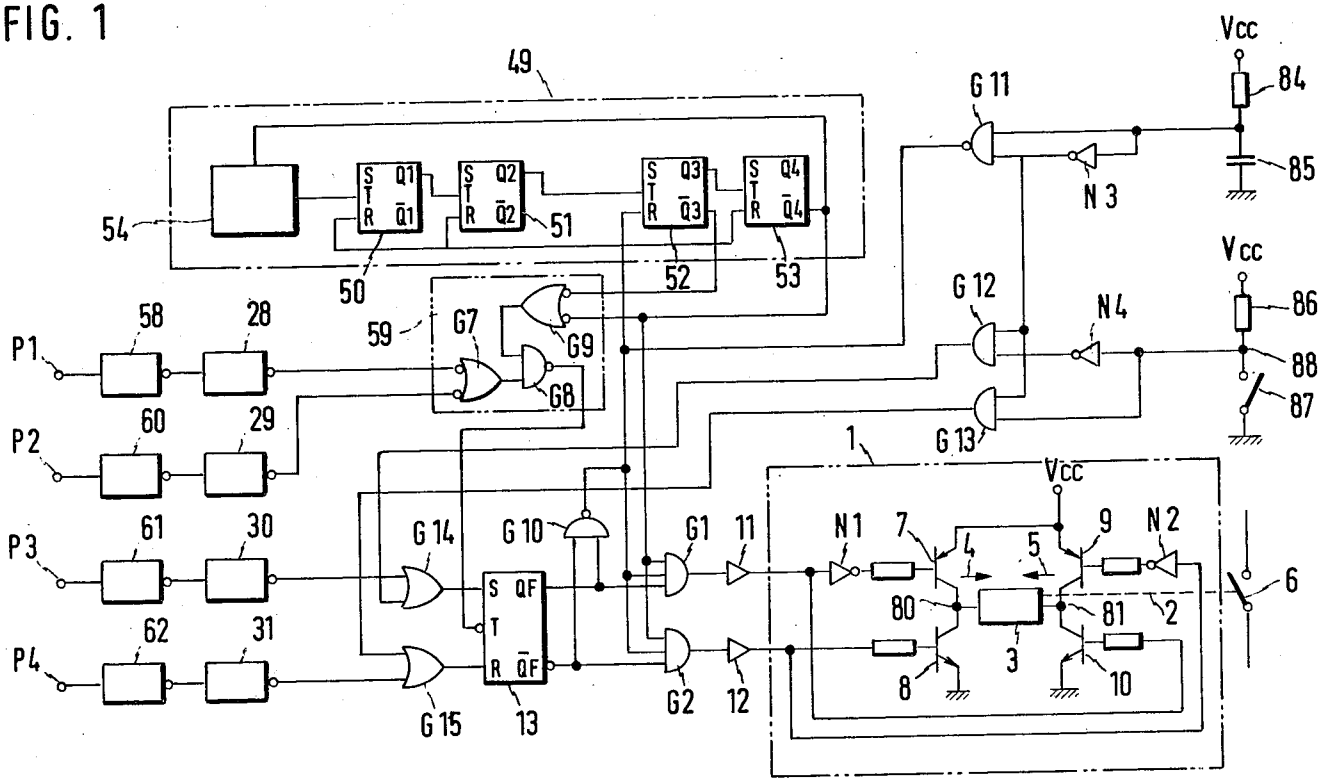
FIG. 1 is a block circuit diagram of a drive circuit according to this invention.

Referring to FIGS. 1 through 13, in the drive circuit for the latching relay, a switching circuit 1 of semi-conductors includes a latching relay 2 of a single winding type. When an exciting current flows in a relay coil 3 in the directions of the arrows 4, 5, a relay switch 6 connected to the exterior changes in the switching condition corresponding to the direction of exciting current so as to selfmaintain the switching condition even after no exciting current flows. One terminal of relay coil 3 is connected to a node 80 of first and second transistors 7, 8 and the other is connected to a node 81 of third and fourth transistors 9, 10.

An output from an amplifier 11 is applied to the base of transistor 10 and also to the base of transistor 7 through an inversion circuit N1. An output from another amplifier 12 is applied to the base of transistor 8 and also to the base of transistor 9 through an inversion circuit N2, outputs from AND gates G1, G2 are applied to amplifiers 11, 12 respectively.

FIG. 2 is a concrete electric circuit diagram of a flip-flop 13 in FIG. 1, in which a first input signal from a set input terminal S is applied to a NOR gate G3. The NOR gate G3 is connected in series with a delay circuit 82 comprising a resistance 14, condenser 15 and inversion circuits 16, 17, a second input signal from a reset input terminal R being fed to NOR gate G4. The first and second input signals are changed-over by output bits of CPU at high speed of 100 μsec time value. An output from NOR gate G4 is fed to another delay circuit 83 comprising a resistance 18, condenser 19 and inversion circuits 20, 21, the delay circuits 82, 83 serving to cut an extremely short noise signal. The output from inversion circuit 17, that is, reset output QF of the first control output of a flip-flop 13, is applied to NOR gate G4. The output from inversion circuit 21, that is, reset output $\overline{QF}$ of the inverse control signal to the above, is connected to NOR gate G3. NOR gates G3, G4 are supplied with a signal from a circuit 22 for toggle function, a signal from a toggle input terminal T being inverted by an inversion circuit 23, the inversion output from which is shown in FIG. 3-(1). The output of inversion circuit 23 is fed to one input of a NAND gate 27 through inversion circuit 24, resistance 25 and condenser 26, and is applied directly to the other input of NAND gate 27. The output of condenser 26 is shown in FIG. 3-(2); the output of NAND gate 27, in FIG. 3-(3); the output of NOR gate G3, in FIG. 3-(4); the output from inversion circuit 17, i.e., the set output QF of flip-flop 13, in FIG. 3-(5); the output of NOR gate G4, in FIG. 3-(6); and the output from inversion circuit 21, i.e., the reset output $\overline{QF}$ of flip-flop 13, in FIG. 3-(7). The flip-flop 13 allows the set output $\overline{QF}$ and reset output QF to be equal only for time periods $T_1$ and $T_2$ as shown, where the first and second inputs are discriminated from other noise signals regarding the time.

Figure 4:
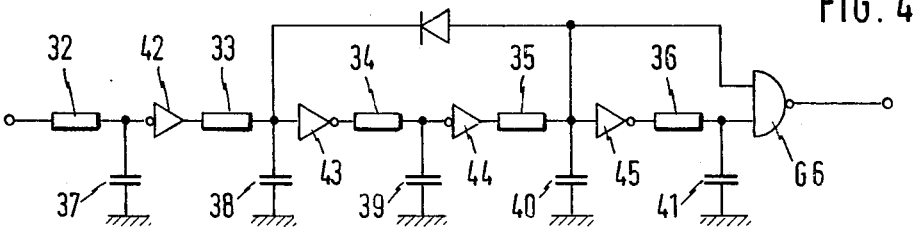
FIG. 4 is a detailed circuit diagram of a pulse forming circuit of FIG. 1.
Figure 5:
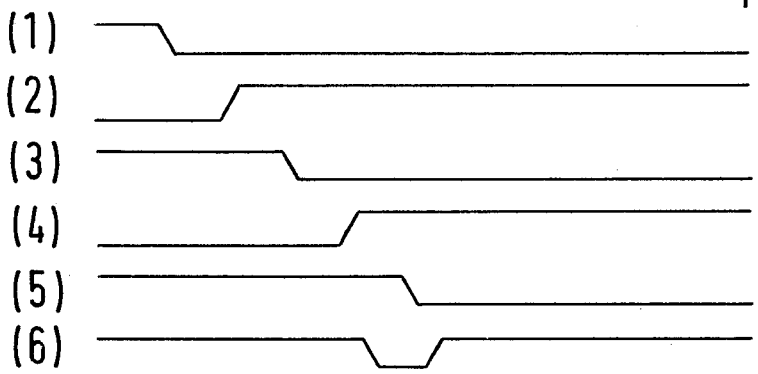
FIGS. 5 and 6 show, respectively, time plots of signals in a pulse forming circuit of FIG. 4.
Figure 6:
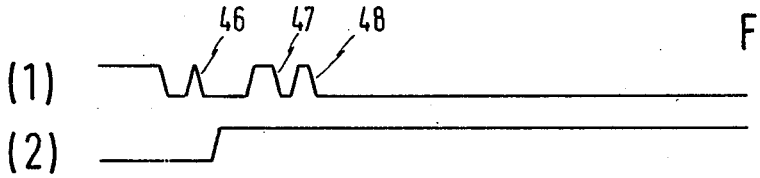

FIG. 4 represents a concrete electric circuit of a pulse forming circuit 29. Pulse forming circuits 30, 31 are constituted similarly to pulse forming circuit 29 and include resistances 32 to 36, condensers 37 to 41 of integrating type, and inversion circuits 42 to 45, NAND gate G6 being given outputs of integrating condensers 40, 41. Inversion circuits 42 to 45, when given an input signal shown in FIG. 5-(1), can output signals as shown in FIGS. 5-(2) to -(5) respectively, NAND gate G6 leasing out the output as shown in FIG. 5-(6). Such pulse forming circuits 28 to 31, as shown in FIG. 6-(1), even when pulse 46 to 48 less than 30 μsec are given, allow the output from inversion circuit 42 not to change and respond as shown in FIG. 6-(2), thereby making it possible to prevent a malfunction caused by noises. Pulse forming circuit 28 uses an exclusive OR gate in place of NAND gate G6.

Figure 7:
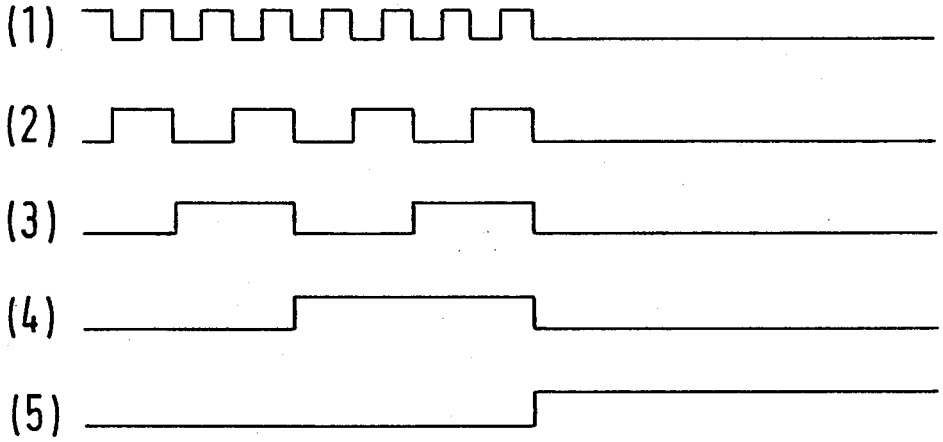
FIG. 7 is a time plot of signals in a timer in FIG. 1.

A clock circuit or timer 49 includes four flip-flops 50 to 53 connected in continuation and each having a toggle input terminal and a monostable multivibrator 54 giving to flip-flop 50 at the initial stage a periodical signal shown in FIG. 7-(1), the multivibrator 54 oscillating when reset output $\overline{Q4}$ of flip-flop 53 at the last stage is at a high level. FIGS. 7-(2) to -(5) show wave forms of set outputs $Q_1$ to $Q_4$ from flip-flops 50 to 53.

Figure 8:
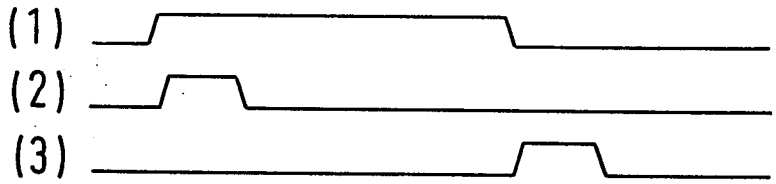
FIG. 8 is a time plot of a monostable function.

We assume that an input terminal is given a monostable signal as shown in FIG. 8-(1), which signal is level-discriminated by a Schmitt circuit 58 not to create a malfunction in a rise time and a falling time and by noises at the low level, and then pulse-formed by pulse forming circuit 28.

Figure 9:
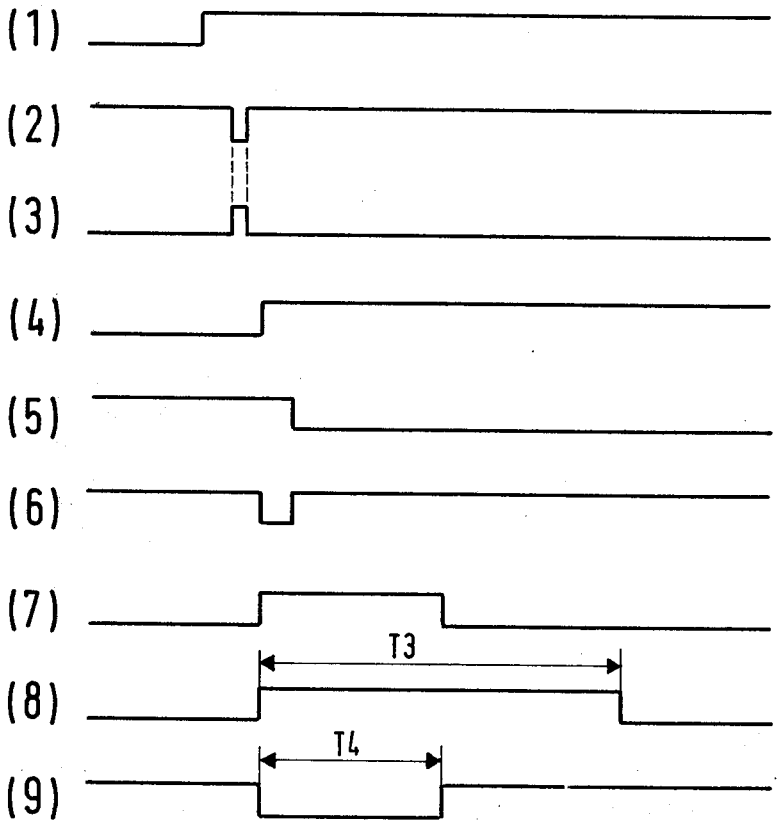
FIG. 9 is a time plot of signals in the double operation protecting circuit in FIG. 1.

FIGS. 9-(1) and -(2) show an input and output of pulse forming circuit 28, FIG. 9-(3) showing an output wave form of NOR gate G7 included in a double function forbidden circuit 59. NAND gate G8 outputs a signal of the inverted wave form in FIG. 9-(3) and gives it to toggle input terminal T at flip-flop 13, whereby set output QF of flip-flop 13 rises as shown in FIG. 9-(4) and reset output $\overline{QF}$ falls as shown in FIG. 9-(5). Hence, NAND gate G10 which is given the set output $\overline{QF}$ and reset output $\overline{QF}$, outputs a signal as shown in FIG. 9-(6). The output of NAND gate G10 is led out at a low level only in a period where both outputs QF, $\overline{QF}$ are at high levels, resets flip-flops 50 to 53 at timer 49, and blocks completion of AND condition. The reset output $Q_4$ of flip-flop 53 rises to a high level by the output of NAND gate G10, to thereby start time-limit operation of timer 49, the reset outputs $\overline{Q_3}$, $\overline{Q_4}$ from flip-flops 52, 53 being shown in FIGS. 9-(7) and -(8). NOR gate G9 of double function forbidden circuit 59 is given the reset outputs $\overline{Q_3}$, $\overline{Q_4}$, and the output of gate G9 is shown in FIG. 9-(9). A time period $T_4$, in FIG. 9-(9), wherein the output from NOR gate G9 is at a low level, is equal to a half of the time-limit period $T_3$ of timer 49 ($T_4=T3/2$), thereby forbidding the next toggle signal to be given to flip-flop 13 from NAND gate G8 during the period $T_4$. Hence, when adjacently continued signals are given to NOR gate G7, a malfunction by noises is prevented due to no change in the stable condition of flip-flop 13. The output from reset $\overline{Q4}$ at flip-flop 53 is given to AND gates G1, G2. After the lapse of time-limit $T_3$, the output from AND gate G1 makes transistors 7, 10 conductive through amplifier 11, whereby an exciting current flows in relay coil 3 in the direction of the arrow 4, the output from AND gate G1 being shown in FIG. 8-(2). The time-limit means a period necessary for changeover of coil 3 at latching relay 2, which has been assumed to be 100 μsec in our experiments.

Also, at the fall time of the monostable signal shown in FIG. 8-(1) and given to input terminal P1, a signal from pulse forming circuit 28 is given to toggle input terminal T at flip-flop 13 through double function forbidden circuit 59, whereby the stable condition of flip-flop 13 changes to lead the output in FIG. 8-(3) out of AND gate G2. Hence, transistors 8, 9 are conductive and an exciting current flows in relay coil 3 in the direction of the arrow 5 for the time-limit $T_3$ only.

The time-limit $T_3$ of timer 49 is selected to be slightly larger than a time period necessary for changing-over relay switch 6 at latching relay 2.

Figure 10:
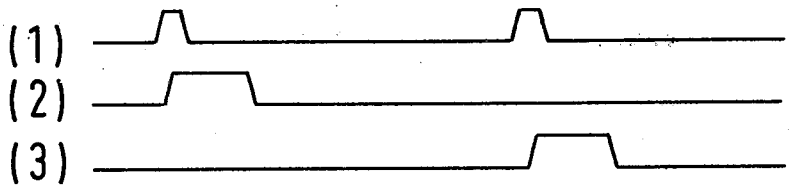
FIG. 10 is a time plot of a toggle function.

The toggle signal, which is given to input terminal $P_2$ as shown in FIG. 10-(1), is given to double function forbidden circuit 59 through Schmitt circuit 60 and pulse forming circuit 29, thus introducing outputs as in FIG. 10-(2) and -(3) from AND gates G1, G2. Therefore, switch 6 changes it switching condition everytime the toggle signal is given.

Figure 11:
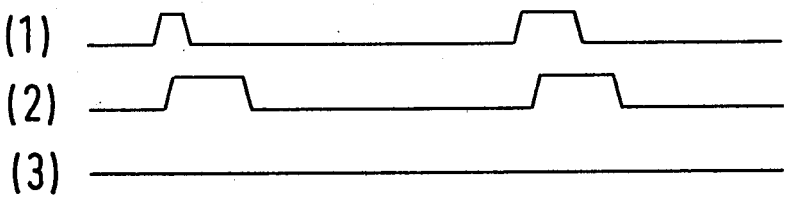
FIG. 11 is a plot diagram of a setting operation.

The set signal, when given to input terminal 93 as shown in FIG. 11-(1), sets flip-flop 13 through Schmitt circuit 61, pulse forming circuit 30 and OR gate G14. AND Gate G1 outputs the signal shown in FIG. 11-(2) everytime the set signal is given, AND gate G2 keeping its output at a low level as shown in FIG. 11-(3).

Figure 12:
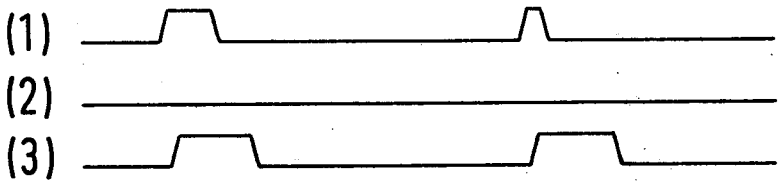
FIG. 12 is a plot diagram of a resting function.

The reset signal, when given to input terminal P4 as shown in FIG. 12-(1), resets flip-flop 13 through the Schmitt circuit 62, pulse forming circuit 31 and OR gate G15. Therefore, AND gate G2 leads out the pulse in FIG. 12-(3), but the output of AND gate G1 is kept in a low level as shown in FIG. 12-(2).

Figure 13:
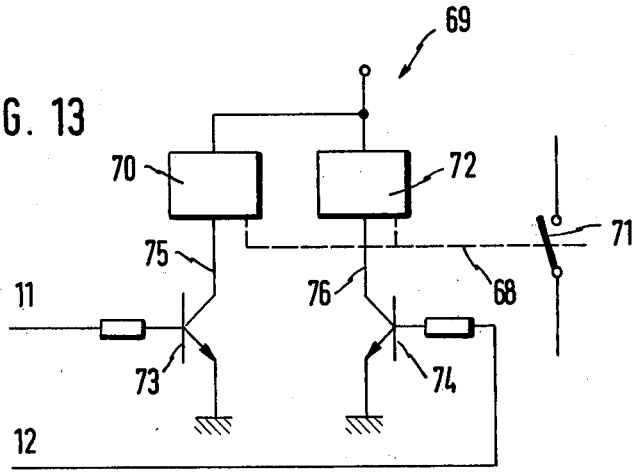
FIG. 13 is a modification of the switching circuit of FIG. 1.

FIG. 13 shows a switching circuit 69 including a latching relay 68 of the so-called double winding type, which circuit 69 substitutes for switching circuit 1 shown in FIG. 1. Latching relay 68, when an exciting current flows in one relay coil 70, changes a switching condition of a relay switch 71 connected to the exterior so as to self-maintain it, and, when the exciting current flows in the other relay coil 72, changes the relay switch 71's condition so as to self-maintain it, the relay coils 70, 72 being connected in series with transistors 73, 74, which are connected at the bases thereof to amplifiers 11, 12 respectively. Such switching circuit 69 also can be brought into pratice concerning this invention. Signals from nodes 75, 76 of relay coils 70, 72 and transistors 73, 74 are detected, thereby making it possible to indirectly check whether the latching relay 68 operates.

Referring to FIG. 1, an output from the constant supply voltage of a stabilized voltage Vcc is given to a series circuit comprising a resistance 84 and condenser 85, the output of condenser 85 being given to one input of AND gate G11 and to the other input thereof through an inversion circuit N3 having level discrimination function. When the power source is on or an instantaneous electric failure is recovered, condenser 85 is charged to raise its output voltage. When the output voltage of condenser 85 is under the discrimination level of inversion circuit N3, AND gate G11 leads out a signal at a high level, whereby flip-flops 50 to 53 included in timer 49 are reset. The discrimination level of inversion circuit N3 is selected to exceed the lowest voltage so that the shown remaining circuit elements are energized by the output from the constant supply voltage and properly operate.

The output from inversion circuit N3 is given to one input of each AND gate G12 or G13, the output from the constant supply voltage being given to a series circuit comprising a resistance 86 and switch 87. An output from a node 88 of resistance 86 and switch 87 is given to the other input of AND gate G13 and to the other input of AND gate G12 through an inversion circuit N4, the output from AND gate G12 resetting flip-flop 13 through OR gate G14, the output from AND gate G13 resetting flip-flop 13 through OR gate G15.

In a case that the power source is turned on or in a recovery from an instantaneous electric failure under a condition of cutting off the switch 87, when the output voltage of condenser 85 is under the discrimination level of inversion circuit N3, AND gate G13 leads out a high level signal, by which flip-flop 13 is reset. When the power source is turned on or an instantaneous electric failure is recovered in the conductive condition of switch 87, if the output voltage from condenser 85 is under the discrimination level of inversion circuit N3, AND gate G12 leads out a high level signal, by which flip-flop 13 is set. When the output voltage of condenser 85 is over the discrimination level, outputs from AND gates G11, G12 and G13 are on low levels, whereby the aforesaid operation is performed according to the signal from input terminals P1 to P4.

Alternatively, the switch 87 may be used as the relay switch for latching relay 2 so that when an exciting current flows in relay coil 3 in the direction of the arrow 4, switch 87 is conductive, and conversely, when the exciting current flows in the direction of the arrow 5, switch 87 is off. Hence, the relay switch 6 at latching relay 6 in a condition prior to the turning-on of power-source or the occurrence of instant electric failure, is returned always to the reset condition even after the turning-on of power-source or recovery of instantaneous electric failure. Accordingly, the auto-set and -reset are performable so that one latching relay connected to, for example, eight bits in CPU, is not set in a condition different from the predetermined programm.

What is claimed as new and desired to be protected by Letters Patent is set forth in the appended claims:

1. A drive circuit for a latching relay comprising a flip-flop responding to a first input signal and to a second input signal entered into the drive circuit and providing alternately a first control signal and an inverse control signal as an output corresponding to a change in the flip-flop's stable condition; a timer connected to the output of the flip-flop for receiving the first control signal and the inverse control signal; a semiconductor switching circuit connected to the timer with the timer controlling the semiconductor switching circuit for a constant time period, which produces a control signal in response to a first input signal and an inverse control signal to said control signal in response to a second input signal; a latching relay connected to the semiconductor switching circuit with the latching relay receiving from the semiconductor switching circuit a time limit output such that even if said first and second input signals are given to the drive circuit in an extremely short time after said timer responds to said control signal coming from the flip-flop, a sufficient time period is provided for said time limit output in order to energize and keep on said semiconductor switching circuit during the time period of current sufficient for said latching relay and where even when the output of said control signal is cut off between the first input signal and the second input signal, the latching relay keeps its existing relay working condition; a pair of delay circuits connected to the flip-flop for cutting a noise input signal; a pair of logic gates connected in series each to a corresponding one of the delay circuits; and an input-output terminal disposed at one of said series connected delay circuits and logic gates, which is connected in feedback to an input-output terminal of the other one of said series connected delay circuits and logic gates such that the stable condition of the flip-flop changes in response to said first and second input signals, and when the stable condition changes, a logical value of each output is temporarily made equal.

2. A drive circuit for a latching relay comprising a flip-flop responding to a first input signal and to a second input signal entered into the drive circuit and providing alternately a first control signal and an inverse control signal as an output corresponding to a change in the flip-flop's stable condition;

a timer connected to the output of the flip-flop for receiving the first control signal and the inverse control signal;

a semiconductor switching circuit connected to the timer with the timer controlling the semiconductor switching circuit for a constant time period, which produces a control signal in response to a first input signal and an inverse control signal to said control signal in response to a second input signal;

a latching relay connected to the semiconductor switching circuit with the latching relay receiving from the semiconductor switching circuit a time limit output such that even if said first and second input signals are given to the drive circuit in an extremely short time after said timer responds to said control signal coming from the flip-flop, a sufficient time period is provided for said time limit output in order to energize and keep on said semiconductor switching circuit during the time period of current sufficient for said latching relay and where even when the output of said control signal is cut off between the first input signal and the second input signal, the latching relay keeps its existing relay working condition; and wherein the timer comprises flip-flops in a plurality of stages in continuation;

a multivibrator connected to and periodically providing an oscillation signal to the flip-flop at the initial stage so that the output of the flip-flop at the last stage restricts operation of said multivibrator and is led out as a time limit output for the timer; and gate means disposed to block reception of sequential input signals by means of the output from the flip-flop at an intermediate stage.

3. The drive circuit for a latching relay according to claim 2 further comprising an auto-set and -reset circuit connected to and for detecting a supply voltage at said semiconductor switching circuit such that if the supply voltage is below a predetermined discrimination level said flip-flop is kept in the predetermined stable condition.

4. The drive circuit for a latching relay according to claim 3, and further comprising a delay circuit connected to the flip-flop for cutting a noise input signal.

* * * * *